US005501206A

United States Patent [19]

Takebayashi

[11] Patent Number: 5,501,206

[45] Date of Patent: Mar. 26, 1996

[54] AIR-FUEL RATIO CONTROL SYSTEM FOR ENGINE

[75] Inventor: Hiroyuki Takebayashi, Hiroshima, Japan

[73] Assignee: Mazda Motor Corporation, Hiroshima, Japan

[21] Appl. No.: 219,793

[22] Filed: Mar. 29, 1994

[30] Foreign Application Priority Data

Mar. 31, 1993 [JP] Japan ..... 5-072713

[51] Int. Cl.[6] ..... F02D 41/00

[52] U.S. Cl. ..... 123/674

[58] Field of Search ..... 123/674, 486, 123/480, 696, 698, 690, 692

[56] References Cited

U.S. PATENT DOCUMENTS

| | | | |
|---|---|---|---|
| 5,213,088 | 5/1993 | Harada | 123/674 |
| 5,243,951 | 9/1993 | Nakaniwa | 123/674 |
| 5,245,978 | 9/1993 | Orzel | 123/674 |

FOREIGN PATENT DOCUMENTS 60-33316 6/1985 Japan .

*Primary Examiner*—Raymond A. Nelli
*Attorney, Agent, or Firm*—Keck, Mahin & Cate

[57] ABSTRACT

An air-fuel ratio control system, has an air-fuel ratio feedback control for feedback controlling an-air-fuel ratio of a mixture to be supplied into an engine based on a parameter detected from an exhaust gas discharged from the engine so as to set said air-fuel ratio to a target air-fuel ratio in an internal combustion engine. Vaporized fuel is supplied from a fuel tank to the engine. During an initial interval, the supply of vaporized fuel gradually increases. Learning an updating of a control value are accomplished in the feedback control based on a deviation of the air-fuel ratio from the target air-fuel ratio during supply of the vaporized fuel. Upon a resumption of supply of vaporized fuel, a learned value setting arrangement gradually changes the learned control value from zero (0) to a learned control value obtained during a preceding period of supply of vaporized fuel according to a gradually increasing amount of supply of vaporized fuel over a given interval.

15 Claims, 7 Drawing Sheets

START
READ SIGNALS: NE
THW
S11
S12
THW > 80°C?
NO
YES
S14
LEARNING CONDITION?
NO
YES
S15
ADD AND AVERAGE Cfb
S17
Cfb4o(i) ← Cfb4o(i-1)
S16
UPDATE Cfb4o
Cfb4m(i) ← Cfb4m(i-1)
Cfb4 ← 0
S13
S18
Cfb4o < -7%?
NO
YES
S21
Cfb4m ← Cfb3
S19
Cfb4m ← Cfb4o
S22
Xpg = "1"?
NO
YES
S24
Cfb4 ← Cfb4o x Pgrec
S23
Cfb4 ← Cfb4o
S20
Cfb4 ← Cfb4o
RETURN

START

READ SIGNALS: NE
THW
S51
S52
THW > 80°C?
NO
YES
S54
LEARNING CONDITION?
NO
YES
S55
ADD AND AVERAGE Cfb
S58
Cfb4o(i) ← Cfb4o(i-1)
S56
UPDATE Cfb4o
Cfb4m(i) ← Cfb4m(i-1)
Cfb4 ← 0
S53
S57
Cfb4o < -7%?
NO
YES
S60
Cfb4m ← Cfb3
Cfb4 ← Cfb4o
S59
Cfb4m ← Cfb4o
Cfb4 ← Cfb4o
RETURN

AIR-FUEL RATIO CONTROL SYSTEM FOR ENGINE

BACKGROUND OF THE INVENTION

1. Field of the Invention

The present invention relates to an air-fuel ratio control system for an engine, such as an automobile engine, wherein vaporized fuel is purged from the fuel tank.

2. Description of Related Art

Typically, air-fuel control systems for engines of this type are designed and adapted to purge vaporized fuel only when a feedback control of air-fuel ratio is taking place. With such an air-fuel control system, fuel vaporized in the fuel tank is collected in a canister and is purged to an air intake system only when the feedback control of air-fuel ratio is being exercised so that fluctuations in air-fuel ratio caused by the purging of vaporized fuel are canceled or absorbed by means of this feedback control. In other words, the feedback control of air-fuel ratio provides a decrease in the amount of fuel in accordance with the amount of purged vaporized fuel. Such an engine air-fuel control system is known from, for instance, Japanese Unexamined Patent Publication No. 60-33316.

On the other hand, learning control of the air-fuel ratio, which is well known to those skilled in the art, is generally conducted in order to prevent deviations in air-fuel ratio due to deviations resulting from temperature characteristics and deterioration due to aging of a fuel system including a fuel injector and an intake system including an air flow sensor.

When the purging of vaporized fuel is initiated by, for instance, suddenly opening a purge valve to its full opening so as to purge a desired amount of fuel, the feedback control cannot follow up, possibly creating deviations in air-fuel ratio owing to a time lag in control. Therefore, the purge valve is gradually opened so as to cause a gradual increase in the purging amount of vaporized fuel until reaching the desired amount. If the learning control of air-fuel ratio is experienced in engines equipped with such a vaporized fuel supply system, upon a resumption of purging following a temporary interruption of purging after the execution of learning control under a full purging condition, a learned value is obtained during the full purging of evaporated fuel. In this instance, the learned value obtained during the full purging of evaporated fuel is reflected in the feedback control, even if a gradually increasing purging is conducted at the initiation of purging and, hence, a full purging is not achieved. Consequently, because a decrease correction of the supply of fuel during the air-fuel ratio control is made in excess, the air-fuel ratio is controlled to become more lean than the desired or target air-fuel ratio, so that deviations are generated in air-fuel ratio.

A high concentration of vaporized fuel is collected at the top of the canister and is supplied first at the initiation of purging of vaporized fuel, and, thereafter, a stabilized concentration of vaporized fuel is supplied. Therefore, if learning is performed even during this interval, deviations in air-fuel ratio are possibly generated due to the temporary albeit rapid fluctuations in the concentration of vaporized fuel.

SUMMARY OF THE INVENTION

It is an object of the present invention to provide an air-fuel ratio control system in which the generation of deviations in air-fuel ratio caused by learning at the initiation of purging of vaporized fuel purging is avoided.

It is another object of the present invention to provide an air-fuel ratio control system which prevents deviations in air-fuel ratio caused due to use of the learned value obtained during the previous full purging at the initiation of the current purging.

It is still another object of the present invention to provide an air-fuel ratio control system which prevents the generation of deviations in air-fuel ratio due to fluctuations in the concentration of vaporized fuel at the initiation of purging of vaporized fuel.

These objectives are accomplished by providing an air-fuel ratio control system having an air-fuel ratio feedback control means which feedback controls an air-fuel ratio of a fuel mixture to be supplied into an engine based on a parameter detected from an exhaust gas discharged from the engine so as to change the air-fuel ratio toward a target air-fuel ratio and a vaporized fuel supplying means which supplies vaporized fuel from a fuel tank to the engine and, during an initial interval of the supply of vaporized fuel, gradually increases the amount of supplied vaporized fuel to a necessary level. This control means further includes a learning means which learns and updates a control value for the feedback control based on a deviation of the air-fuel ratio from the target air-fuel ratio during the supply of vaporized fuel and a learned value setting means which, upon a resumption of the supply of vaporized fuel, gradually changes the learned control value from zero (0) to a learned control value obtained during a preceding period of the supply of vaporized fuel according to a gradually increasing amount of the supplied vaporized fuel over an interval in which the amount of supplied vaporized fuel is gradually increased. The learning means interrupts learning during the interval in which the amount of supplied vaporized fuel is gradually increased.

The air-fuel ratio control means may be provided, in place of the learned value setting means, a learning interruption means which, upon an initiation of the supply of vaporized fuel, interrupts learning of the learning means during a predetermined interval from the initiation of the supply of vaporized fuel.

With the air-fuel ratio control means according to the present invention, upon the initiation of the supply of vaporized fuel, the quantity of vaporized fuel supplied to the engine is gradually increased until a desired quantity (the full purge quantity) is achieved, and after the achievement of the desired quantity, a full purging is achieved with the continuation of the supply of a quantity of vaporized fuel corresponding to the desired quantity. At the same time, compensation of the air-fuel ratio is made toward the lean side in the feedback control by an amount corresponding to the quantity of vaporized fuel during the full purging, while the learned value is successively computed by the learning means based on the amount of feedback control (amount of compensation) in the full purging of vaporized fuel, the amount of feedback control being successively determined based on the learned value. Furthermore, when the supply of vaporized fuel is once interrupted and, thereafter, resumes again, as a learned value during the gradual increase in the supply of vaporized fuel, the learned value is established by the learned value setting means, which is increasingly altered during the gradual increase in fuel supply from zero (0) to the learned value obtained during the previous full purging, in accordance with the gradual increase in the supply of vaporized fuel, feedback control of the air-fuel ratio being performed on the basis of the learned value. Thus the quantity of vaporized fuel gradually supplied when restarting the vaporized fuel supply is made to correspond to the learned value set by the learned value setting means, thereby preventing the generation of aberrations in the air-fuel ratio caused by a lack of correspondence between the learned value and the quantity of vaporized fuel supplied when the learned value from the previous full purge state is also used during the gradual increase in supply when restarting the supply.

Furthermore, the learning by the learning means is interrupted by the leaning interruption means during the gradual increase in the supply of vaporized fuel. Therefore, the correspondence between the quantity of vaporized fuel increasingly supplied and the learned value set by the learned value setting means increases, making prevention of the generation of deviations in air-fuel ratio more exact.

Otherwise, the learning by the learning means is interrupted by the learning interruption means during a specific interval from the initiation of the supply of vaporized fuel by the vaporized fuel supply means. After the specific interval, the correction of the air-fuel ratio to the lean side is made by feedback control in the air-fuel ratio control means by the amount corresponding to the quantity of vaporized fuel supplied, while the learned value is successively computed by the learning means on the basis of the amount of feedback control (the amount of correction) when supplying the vaporized fuel, and the amount of feedback control is successively determined based on the learned value.

Because learning is interrupted at the initiation of the supply of vaporized fuel, even if highly concentrated vaporized fuel is supplied temporarily at the initiation of the fuel supply, temporary but rapid fluctuations in the vaporized fuel concentration are not reflected in the learned value, thereby preventing the generation of deviations in the air-fuel ratio caused due to the rapid fluctuations in the vaporized fuel concentration when the supply of vaporized fuel is initiated.

BRIEF DESCRIPTION OF THE DRAWINGS

The above and other objects and features of the present invention will be well understood from the following description with respect to preferred embodiments thereof when considered in conjunction with the accompanying drawings, in which.

DETAILED DESCRIPTION OF THE PREFERRED EMBODIMENT

Figure 1:
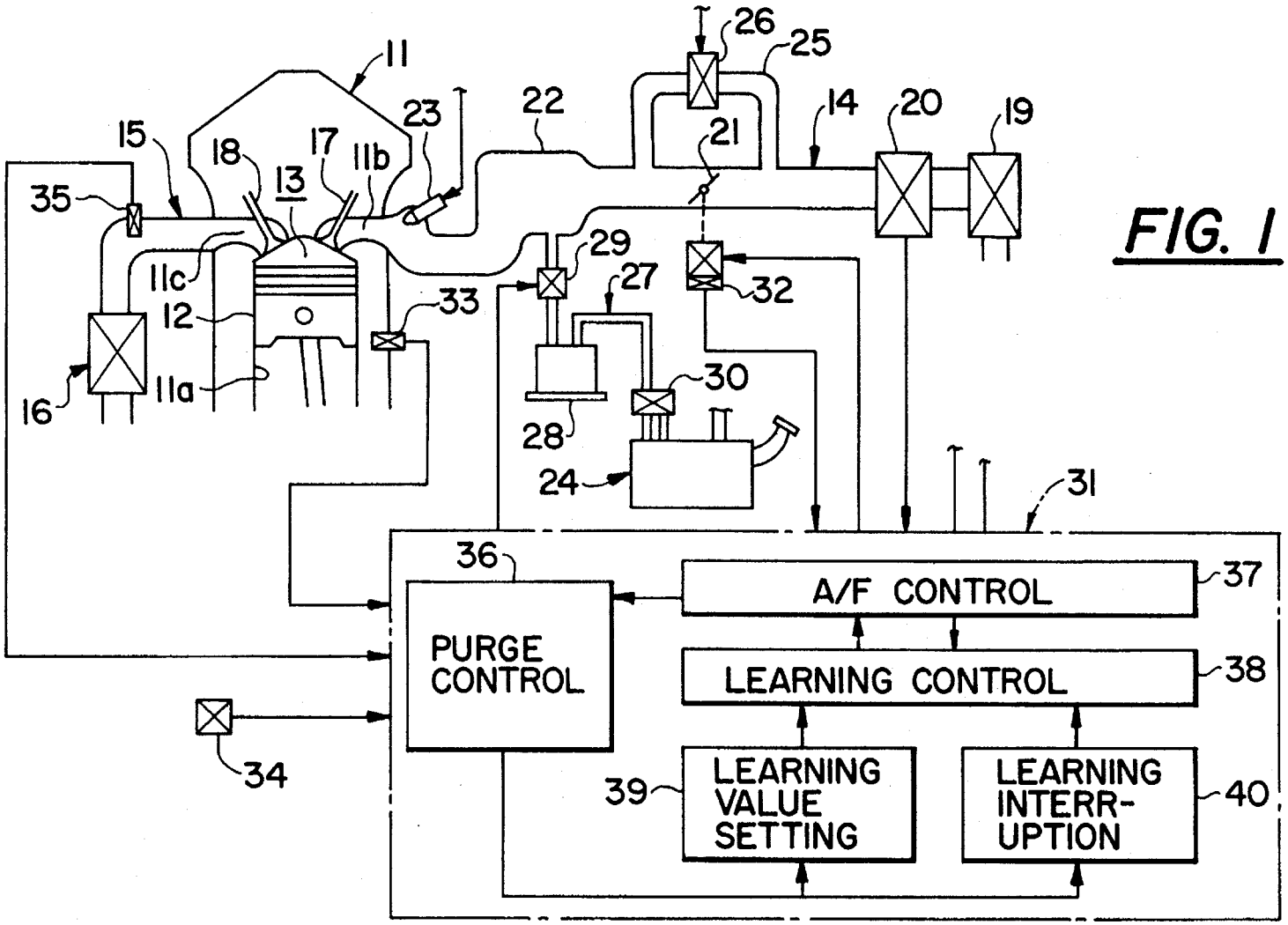
FIG. 1 is a schematic illustration of an internal combustion engine equipped with an air-fuel ratio control system in accordance with a preferred embodiment of the present invention.

Referring to the drawings in detail, and, in particular, to FIG. 1, an automobile internal combustion engine 11 equipped with an air-fuel ratio control system according to a preferred embodiment of the present invention has a reciprocating piston 12 that moves up and down in each of cylinders 11*a*. A combustion chamber 13 is formed above the piston 12 in the cylinder 11*a*. The engine 11 is equipped with an intake line 14 for introducing air into the combustion chamber 13, and an exhaust line 15 for discharging burned gas from the combustion chamber 13. In the exhaust line 15 there is disposed an exhaust gas purifying system 16. In addition, the engine 11 has an intake valve 17 and an exhaust valve 18, which are opened and closed at an appropriate timing in a well known manner.

The intake line 14 is provided, in order from the upstream side or the leading end thereof, with an air cleaner 19, a hot wire type of air flow sensor 20 for detecting the quantity Qa of air introduced through the air cleaner 19, a throttle valve 21 and a surge tank 22 for absorbing pulsations of intake air. A fuel injector 23 is mounted next to an intake port 11*b* to which one end of the intake line 14 is connected. The fuel injector 23 is connected to a fuel tank 24 through a fuel line (not shown) so as to inject a specific amount of fuel at an appropriate timing controlled by a control unit 31 which will be described in detail later.

The intake line 14 is further provided with a bypass line 25 so as to allow intake air to flow bypassing the throttle valve 21. In the middle of the bypass line 25 there is provided an idle speed control valve, namely an ISC valve 26, opening of which is controlled by an idle speed control means (not shown) incorporated within the control unit 31. The ISC valve 26 is designed and adapted to prevent a drop in speed of the engine 11 caused due to a load when an air conditioner (hereafter referred to as an A/C) is operated, a load from a power steering, and/or a load when the rear defogger is operating, and to provide an increasing correction of intake air so that the engine 11 maintains a specific target idle speed of rotation.

The surge tank 22 in the intake line 14 is communicated by a purge line 27 to the fuel tank 24 via canister 28 so as to supply vaporized gaseous fuel to the engine 11. The canister 28 serves as a reservoir for the vaporized gaseous fuel. Between this canister 28 and the surge tank 22 there is provided in the purge line 27 a purge valve 29 for opening and closing the purge line 27. The purge valve 29 is controlled by a purge control means 36 also incorporated in the control unit 31 to open so that, when the engine has warmed up, specifically, when a water temperature sensor 33 detects a specific temperature, for instance 80° C., a specific quantity of vaporized fuel is purged into air in the intake line 14. This purged fuel is then supplied into the combustion chamber 13 together with fuel injected from the injector 23 and burned therein. A separator 30, which is disposed in the purge line 27 between the canister 28 and the fuel tank 24, separates liquid fuel out of vaporized gaseous fuel from the fuel tank 24 and returns it into the fuel tank 24.

Control unit 31 receives various signals from the air flow sensor 20, a throttle opening sensor 32 for detecting the degree of opening of the throttle valve 21, the water temperature sensor 33, provided on the engine 11, for detecting the temperature of cooling water, an engine speed sensor 34 for detecting the rotational speed of the engine, and an oxygen ($O_2$) sensor 35 provided on the exhaust line 15 before the exhaust gas purifying system 16 so as to function as an air-fuel ratio detector. Further, in relation to the control unit 31 there are provided various switches (not shown) used to detect whether the A/C, the power steering, or the rear defogger are in operation or not, and an idle switch (not shown) which cooperates with the throttle opening sensor 32 so as to provide an ON signal when the throttle valve is in its idle position. There are incorporated in the control unit 31 a purge control means 36 for controlling opening of the purge valve 29 in accordance with the temperature of engine cooling water detected by the temperature sensor 33, an air-fuel ratio control means 37 for feedback controlling the quantity of fuel to be injected from the fuel injector 23 based on signals from the various sensors so as to develop a specific target air-fuel ratio of a fuel mixture to be supplied into the combustion chamber 13. The control unit 31 further includes a learning means 38, a learned value setting means 39, and a learning interruption means 40. The learning means 38 computes a learned value based on a feedback control constant Cfb used in the air-fuel ratio control means 37, sends it to the air-fuel ratio control means 37 and stores and updates the learned value. On the other hand, the setting means 39 sets a learned value for a specific time interval from the initiation of the purge control by the purge control means 36, and the learning interruption means 40 suspends learning in the learning means 38 for the same specific time interval after the initiation of the purge control by the purge control means 36. The purge control means 36 is designed and adapted to set a purge execution flag Xpg to the state of "1" when the engine has warmed up, i.e. when the water temperature sensor 33 detects the temperature of engine cooling water of, for example, 80° C., as shown in the time chart in FIG. 2, and then to open the purge valve 29. At this time, the opening of the purge valve 29 is gradually increased based on the variable rate of purge Pgrec as shown in the time chart. This variable purge rate Pgrec is determined as a function of time such that it takes 1.0 for a purged quantity of vaporized fuel at the full purging position of the purge valve 29 and zero (0) for no purging at the stop down position of the purge valve 29. More specifically, it is continuously maintained at a certain low rate for a certain interval after the initiation of purging, and then, gradually increases to 1.0 with time. The time or interval necessary for the variable purge rate Pgrec to gradually increase from zero (0) to 1.0 is defined as a variable time or interval.

Figure 3:
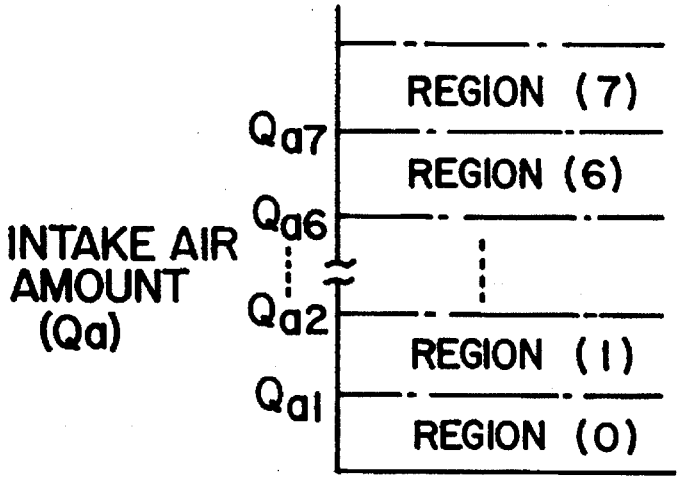
FIG. 3 is an illustration showing partial learning regions.

The learning means 38 has two different learned values before and after the end of warming up of engine or the temperature of engine cooling water of approximately 80° C., namely a cold region learned value Cfb3, which is used in the range of engine operation from the cold start of engine operation just before the termination of engine warming-up, and a hot region learned value Cfb4 which is used in the stable range of engine operating following the termination of warming-up. Additionally, each cold region learned value Cfb3 and the hot region learned value Cfb4 retains a value in each of partial load regions, such as a partial learning region (0), a partial learning region (1), . . . , a partial learning region (6), a partial learning region (7) etc., as shown in FIG. 3, which are divided according to the quantity Qa of intake air. In other words, these cold region learned values Cfb3 and hot region learned value Cfb4 are different from one another depending upon driving condition of the engine, as represented by the quantity Qa of intake air, and are stored in a memory. Additionally, purging of vaporized fuel performed by the purge control means 36 is conducted in the partial regions after the completion of warming-up, and learning takes place during purging of vaporized fuel. In other words, purging of vaporized fuel is conducted when feedback control conditions based on the hot region learned value Cfb4 have developed, i.e. when the temperature of engine cooling water has reached 80° C. In this instance, the partial learning region (0) is assigned to the region of idling and the learned value for the partial learning region (0) is applied when the idle switch provides an ON signal.

In the learning means 38, the learned values Cfb3 and Cfb4 are successively added and averaged by multiplying them at specific time intervals by the feedback control constant Cfb used in the air-fuel ratio control means 37 so as to feedback control an air-fuel ratio to the target air-fuel ratio, and then are updated. Then the updated learned values Cfb3 and Cfb4 are successively output to the air-fuel ratio control means 37, while, at the same time, they are substituted for previous learned values Cfb3 and Cfb4 and stored in the memory of the learning means 38 for memory backup.

Figure 4:
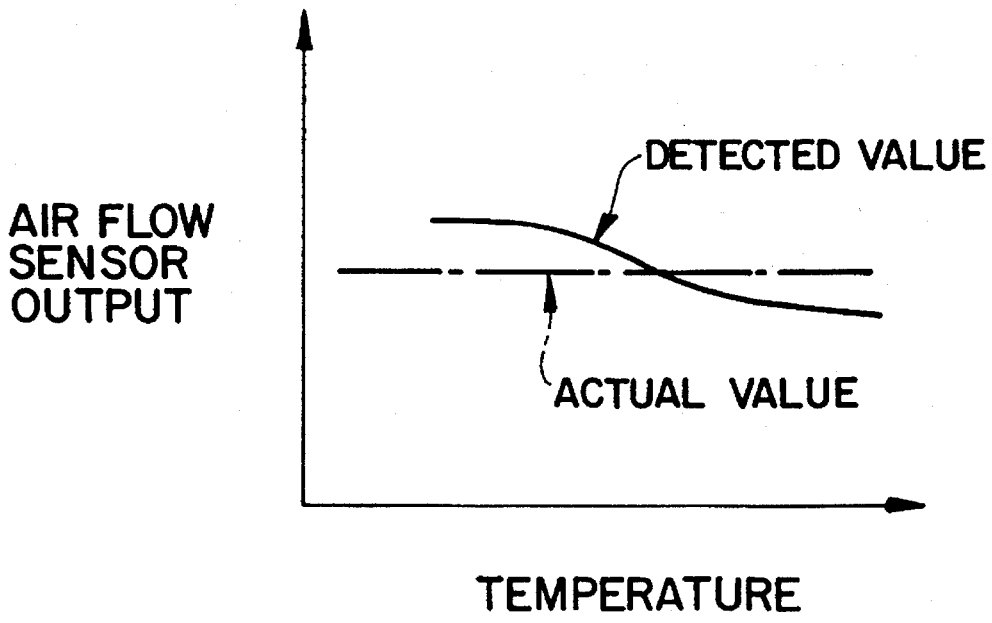
FIG. 4 is a diagram showing the relation between air flow sensor output and temperature.

In addition, the learning means 38 has a lower limit guard value (LLGV) for the hot region learned value Cfb4 stored in the memory, and, when the updated hot region learned value Cfb4 is smaller than the lower limit guard value (LLGV), it suspends the updating of the memorized hot region learned value Cfb4 stored in the memory and resets the backup value in the memory corresponding to the hot region learned value Cfb4 to the cold region learned value Cfb3. Thereafter, this cold region learned value Cfb3 is backed up in the memory as a fixed value. The lower limit guard value (LLGV) discussed above is a value established in consideration of operational tolerance of the whole system, such as the fuel injection system including the injector 23 and the intake system including the air flow sensor 20. For instance, as shown in FIG. 4 relating to the air flow sensor 20, the air flow sensor 20 generally has temperature characteristics which create temperature related deviations between output values and actual values. For this reason, the lower limit guard value (LLGV) is established in consideration of tolerance relating to the temperature characteristic. In addition, a lean side correction, which is conducted due to the effects of vaporized fuel purging when the hot region learning value Cfb4 becomes smaller than the lower limit guard value (LLGV), is another reason. When a change occurs from larger to smaller, it is judged that a full purging condition of vaporized fuel has occurred (see FIG. 2), then, the updating of hot region learned value Cfb4 is suspended. On the other hand, under any purging conditions other than the full purging condition, the updated value of an computed hot region learned value Cfb4 is successively stored in memory.

The air-fuel ratio control means 37 is designed and adapted to cause the injector 23 to inject fuel of a quantity controlled based on a total value of the feedback constant Cfb and a cold region learned value Cfb3 or an hot region learned value Cfb4.

The learned value setting means 39 sets, as the learned value Cfb4 for the interval of gradually increasing purge from the resumption of purging after the interruption of purging, a learned value Cfb4rec that gradually increases toward the lean side from a value of zero (0) to the learned value Cfb4 (−15% in FIG. 2) obtained immediately prior to the interruption of purging in the previous full purging condition, and sends it to the learning means 38. In other words, the learned value setting means 39 sets a learned value Cfb4rec varying with the same characteristic as the gradual increase of purge.

The learning interruption means 40 is designed and adapted to interrupt learning in the learning means 38 by making the learning execution flag Xln (see FIG. 2) to the state of "0" over the interval of gradually increasing purge.

Figure 5:
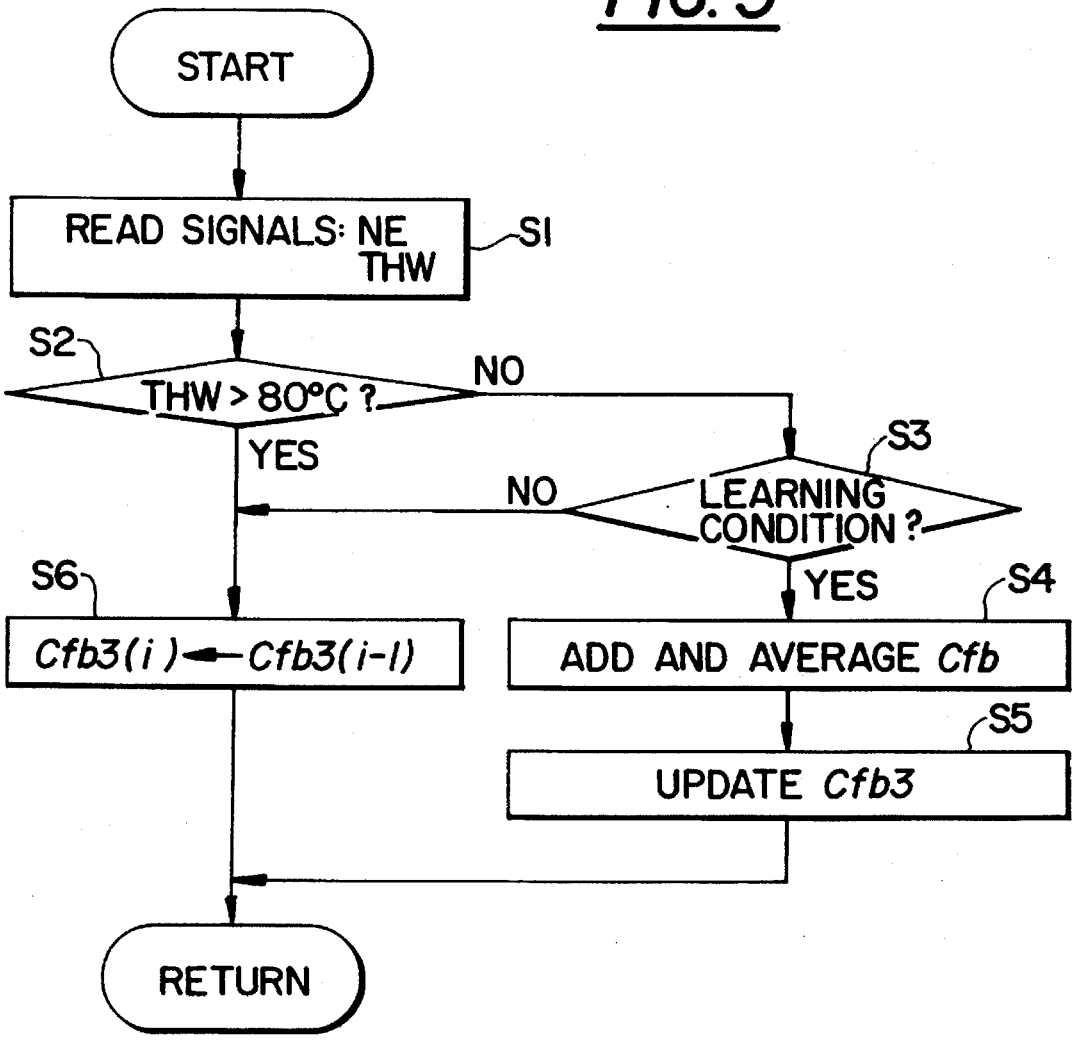
FIG. 5 is a flow chart of the cold range learned value computation sequential routine.
Figure 6:
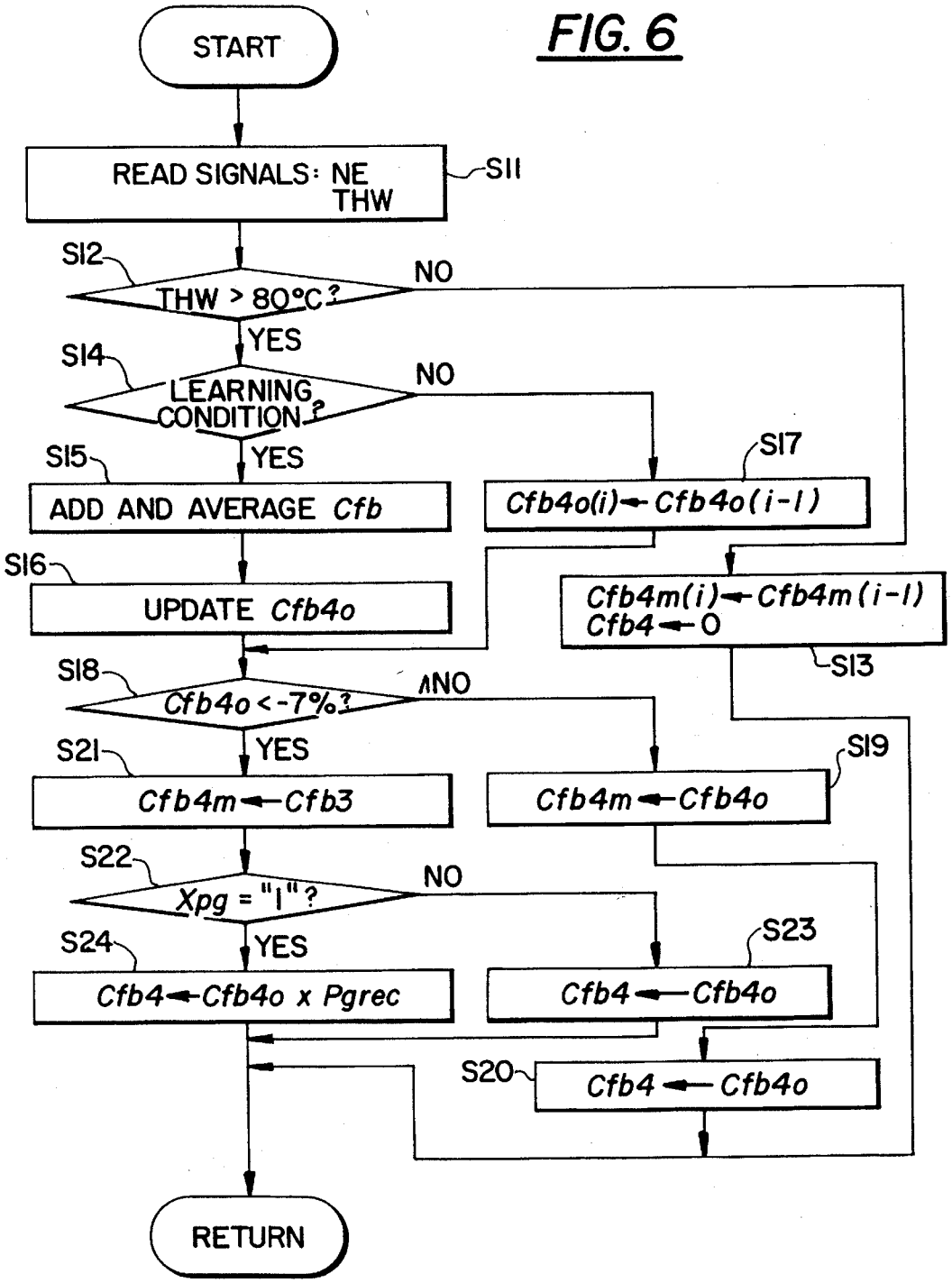
FIG. 6 is a flow chart of the control value learning and setting and learning interruption sequential routine.

The operation of the air-fuel ratio control system depicted in FIG. 1 will be best understood by reviewing FIGS. 5 and 6, which are flow charts illustrating routines for the microcomputer of the control unit 31. Programming a computer is a skill well understood in the art. The following description is written to enable a programmer having ordinary skill in the art to prepare an appropriate program for the microcomputer. The particular details of any such program would of course depend upon the architecture of the particular computer selected.

Referring to FIG. 5, which is a flow chart of the cold region learned value processing routine for the microcomputer, after reading signals representative of an engine speed NE and the temperature of engine cooling water THW at step S1, a decision is made at step S2 as to whether or not the engine water temperature THW is above 80° C., i.e. whether or not the engine has warmed up sufficiently to conduct the purging of vaporized fuel. If the engine is still cold, or when the answer to the decision is "NO," another decision regarding the achievement of learning conditions is made at step S3. If these conditions have been achieved, then, feedback control constants Cfb for the interval between the previous achievement of the learning conditions and the current achievement are added and averaged to compute the current cold region learned value Cfb3 at step S4. This cold region learned value Cfb3 is updated at step S5 by replacing the previous one with the current one. The updated cold region learned value Cfb3 is output to the air-fuel ratio control means 37 and simultaneously is substituted for the backup value, i.e. the previous cold region learned value, stored in the memory as a new backup value.

On the other hand, when the answer to the decision regarding the temperature of engine cooling water made at step S2 is "YES," i.e. the engine has sufficiently been warmed up, or when the answer to the decision regarding the achievement of learning conditions made at step S6 is "NO," the previous cold region learned value Cfb3(i-1) is set as the current cold region learned value Cfb3(i) at step S6. In other words, the cold region learned value Cfb3 immediately prior to purging is maintained Referring to FIG. 6, which is a flow chart of the hot region learned value control routine for the microcomputer, it is recalled from the above description that this routine starts after the initiation of purging The sequence commences and control proceeds directly to step S11 where signals representative of an engine speed NE and the temperature of engine cooling water THW are read Then, a decision is made at step S12 as to whether or not the engine water temperature THW is above 80° C. If the answer is "NO" then, the control proceeds to step S13 where the value of zero (0) is substituted for the hot region learned value Cfb4 and as the current backup value Cfb4(i) for the warm learned value Cfb4, the previous backup value Cfb4(i-1) is retained.

On the other hand, if the answer to the decision is "YES," another decision regarding the achievement of learning conditions is made at step S14. Concerning the achievement of learning condition, the learning condition is judged to have not been achieved in the state where the interruption of purging is taking place or in the state where the purging is in the interval of gradually increasing purge, and to have been achieved in all other purging states If the learning conditions have not been achieved, then, the control advances to step S17, passing through step S18, which will be described later. If the learning conditions have been achieved, then, after adding feedback control constants Cfb for the interval between the previous achievement of the learning conditions and the current achievement of the learning conditions and averaging it to compute the current hot region learned value Cfb4o at step S15, updating of this hot region learned value Cfb4o is made at step S16 by replacing the previous one with the current one. On the other hand, if the answer to the decision regarding the achievement of learning conditions made at step S14 is "NO," then, the previous hot region learned value Cfb4o(i-1) is retained as a current hot region learned value Cfb4o(i).

After the updating of the hot region learned value Cfb4o either at step S16 or at step S17, a decision is made at step S18 as to whether or not the current hot region learned value Cfb4o is smaller than the lower limit guard value (LLGV), i.e. −7%. If it is larger than the lower limit guard value (LLGV), after backing up the current hot region learned value Cfb4o in the memory as the backup value Cfb4m at step S19, the computed hot region learned value Cfb4o is substituted for the current control value Cfb4, which is then output to the air-fuel ratio control means 37, at step S20.

On the other hand, if the current computed hot region learned value Cfb4o is smaller than the lower limit guard value (LLGV), i e. the answer to the decision made at step S18 is "YES," then, the control proceeds to step S21 where the cold region learned value Cfb3 obtained immediately prior to the execution of purging is backed up in the memory as a backup value Cfb4m. Subsequently, at step S22, a decision is made as to whether or not the purge execution flag Xpg has changed from the state of "0" to the state of "1" or whether it is maintained in the state of "1," in other words, whether purging has once been interrupted after the full purging state and then resumed again, or whether it is maintained in the full purging state. If the full purging state is still maintained, the computed hot region learned value Cfb4o is set as a control hot region learned value Cfb4, and is output to the air-fuel ratio control means 37 at step S23. That is, when the full purging state is maintained, the hot region learned value Cfb4o computed based on the feedback control constant Cfb is used as the hot region learned value in the learning control, regardless whether it is smaller than the lower limit guard value (LLGV). In this regard, updating of the hot region learned value Cfb4o for the backup value Cfb4m is not made. In lieu of this, the cold learned value Cfb3 for the non-purge state is maintained in the memory as a fixed value and is used at the start of the next sequential routine. In this instance, a lower limit value (LLV), for instance −15% (see FIG. 2), is previously established for a control value Cfb4 based on elements of the entire system that cause fluctuations. Although the flow-chart does not show, when the computed hot region learned value Cfb4o is used as the control value Cfb4, the control value Cfb4 is controlled so as not to become smaller than the lower limit value (LLV).

On the other hand, when the answer to the decision made at step S22 is "YES," this indicates that purging is resumed after it has once stopped, then, the control proceeds to step S24 where the computed hot region learned value Cfb4o is multiplied by the variable purge rate Pgrec and is substituted for the current control value Cfb4. This current control value Cfb4 is sent to the air-fuel ratio control means 37. That is, the control sets the learned value Cfb4rec which varies with the same characteristic as the gradual increase characteristic of purge at the start of vaporized fuel purging.

Figure 2:
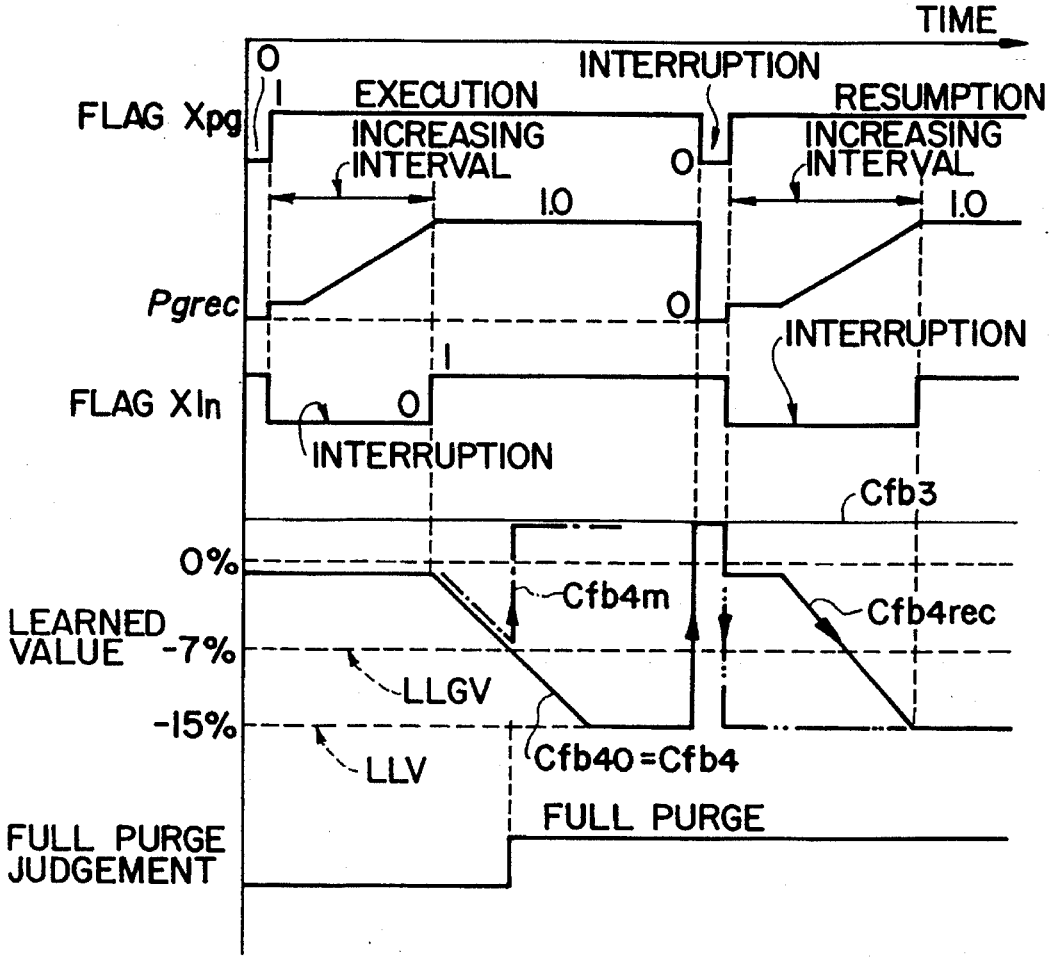
FIG. 2 is a time chart showing the execution of vaporized fuel purging and control value learning.

The operation of the air-fuel control system depicted in FIG. 1 will be more clearly understood by reviewing FIG. 2, which shows a time chart.

Referring to FIG. 2, until the engine has warmed up, the control of air-fuel ratio is performed only in a feedback control, in which the cold range learned value Cfb3 in the non-purge state is used, without executing the purging of vaporized fuel. When the engine has warmed up, the purge valve 29 is opened, starting the purging of vaporized fuel, while the cold range learned value Cfb3 is replaced by the hot range learned value Cfb4. Subsequently, the feedback control of air-fuel ratio during purging uses the hot range learned value Cfb4 as a control value.

At this time, upon the commencement of purging of vaporized fuel, a gradually increasing purge of vaporized fuel is performed based on the variable purge rate Pgrec. During this interval of gradually increasing purge, learning is interrupted or suspended by the learning suspension means 40. By this means, it is possible to prevent a temporary change in the concentration of vaporized fuel from being reflected on the learned value even when the high concentration of vaporized fuel accumulating at the top of the canister 28 is purged at the beginning of purging, thereby making it possible to prevent the generation of deviation in air-fuel ratio that is caused by the large temporary change in concentration due to the reflection of the change on the learned value.

When a full purging is attained after the interval of gradually increasing purge has elapsed, the purged amount of vaporized fuel supplements the fuel injected from the injector 23. Consequently, the feedback control decreases the amount of fuel to be injected from the injector 23, so as to bring the fuel mixture into lean, thereby changing the feedback constant Cfb smaller. With this feedback control, the hot range learned value Cfb4 is also changed gradually smaller. When the computed hot region learned value Cfb4o, which is updated successively to the lower side, falls as far as the lower limit guard value (LLGV) of −7%, the determination of full purging is made, so that the backup value Cfb4m of the hot range learned value is reset to the cold range learned value Cfb3 and memorized, as an updated backup value that is not influenced by the purge of vaporized fuel, for use at the time of restarting. On the other hand, the computed hot range learned value Cfb4o, which is updated successively to a decreasing side, is used as the control value Cfb4 for the hot range learned value used in the feedback control of air-fuel ratio, even if the computed hot range learned value Cfb4o becomes smaller than the lower limit guard value (LLGV). However, when the computed hot range learned value Cfb4o decreases as far as the lower limit (LLV) of −15%, the control value Cfb4 is set to the lower limit value (LLV) of −15%.

When purging is temporarily interrupted, the learned value is switched to the cold range learned value Cfb3, and upon the resumption of purging, it is switched from the cold range learned value Cfb3 to the learned value Cfb4rec having been set by the learned value setting means 39. This learned value Cfb4rec changes matching the characteristic of gradual increase of purge at the commencement of purging. Consequently, it is enabled to have the purged amount of vaporized fuel, which gradually increases when purging resumes, correspond to the learned value, i.e. the learned value Cfb4rec. In this manner, the development of an unreasonably lean condition due to decreasing compensation in excess when the learned value Cfb4, obtained at the last time of full purging, from the beginning of the interval of gradually increasing purge (as shown by dashed line FIG. 2) is prevented, thereby preventing the generation of deviations in air-fuel ratio.

Figure 7:
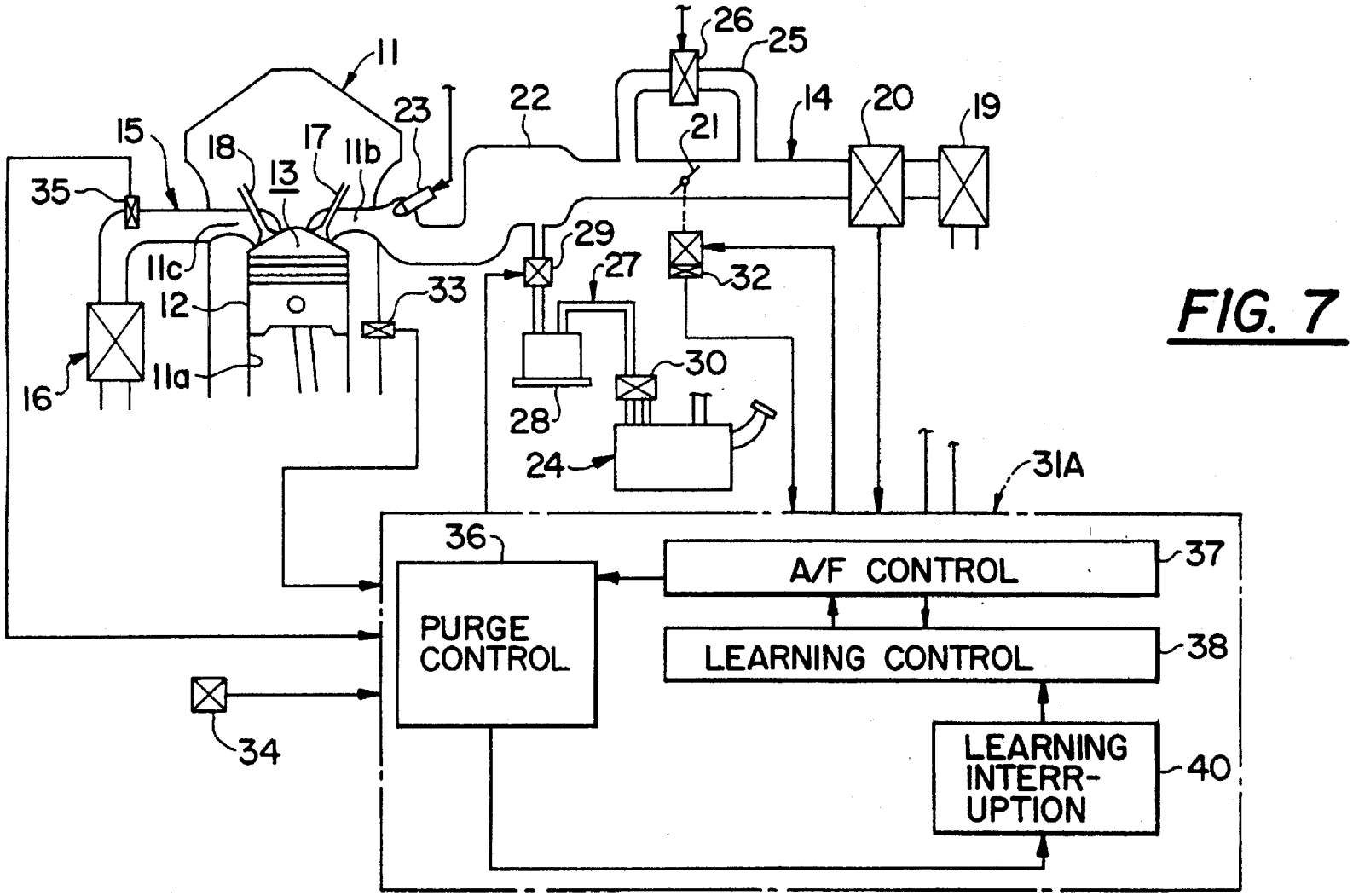
FIG. 7 is a schematic illustration of an internal combustion engine equipped with an air-fuel ratio control system in accordance with another preferred embodiment of the present invention.

FIG. 7 shows an air-fuel control system in accordance with another preferred embodiment of the present invention which is similar to that of the previous embodiment, excepting a control unit 31A. The following description will be directed only to the difference of the air-fuel control system of this embodiment from that of the previous embodiment. The control unit 31A includes a purge control means 36, an air-fuel ratio control means 37, a learning means 38 and a learning interruption means 40.

Figure 8:
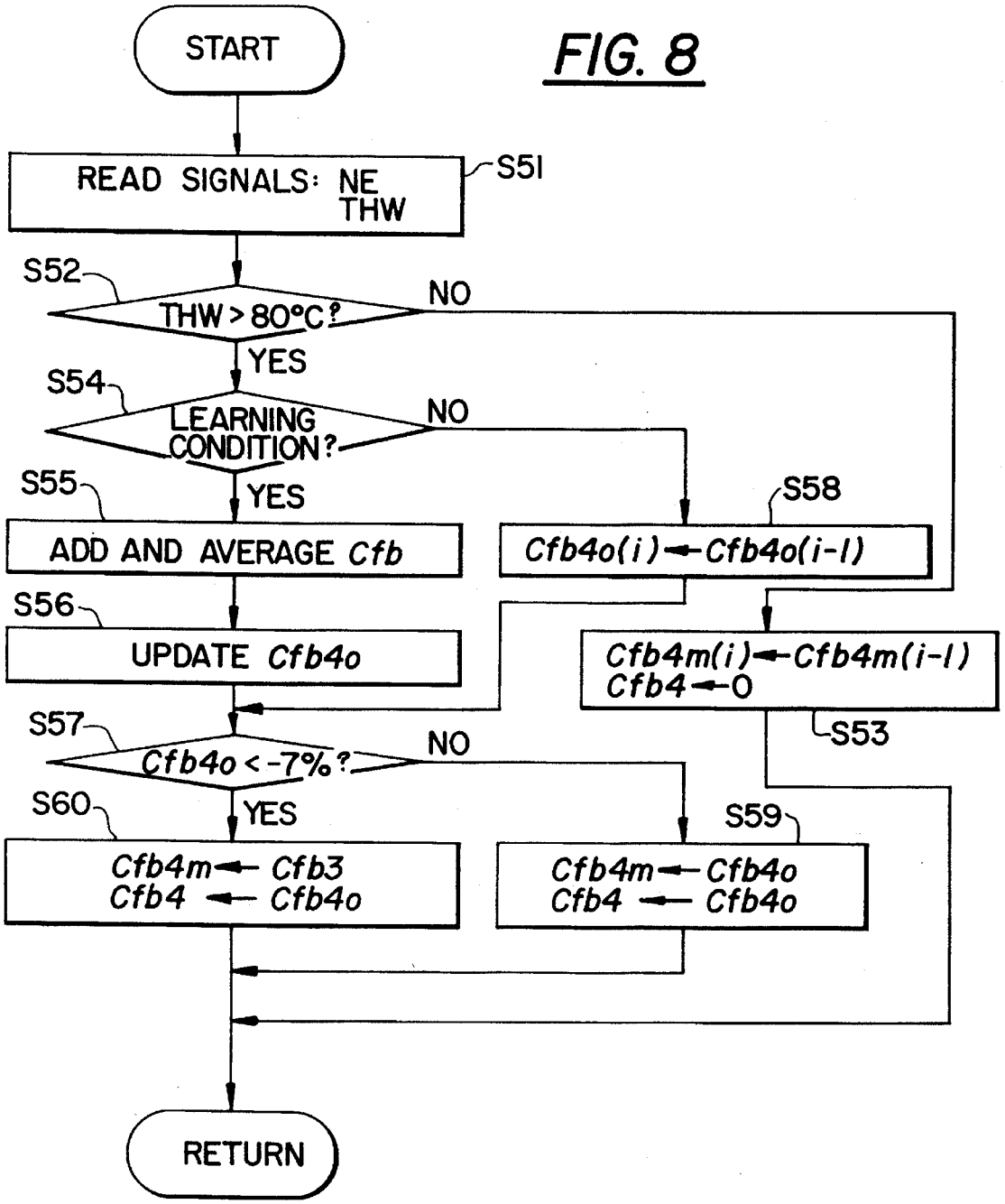
FIG. 8 is a flow chart of the hot range learned value learning and setting and learning interruption sequential routine.

The operations of the learning means 38 and the learning interruption means 40 relating to the hot range learned value Cfb4 will be best understood by reviewing FIG. 8, which is a flow chart of a sequential routine. The sequential routine commences and control proceeds to step S51 where signals representative of an engine speed NE and the temperature of engine cooling water THW are read. Subsequently, a decision is made at step S52 whether or not the engine 11 is in a pre-purge state prior to the execution of purging of vaporized fuel based on the temperature of engine cooling water THW. If the answer to the decision is "NO," this indicates that the engine is in the pre-purge state, then, a hot range learned value Cfb4 is set to a value of zero (0) and, simultaneously, a previous backup value Cfb4m(i-1) is retained as a current backup value Cfb4m(i) for the hot range learned value Cfb4 at step S53. When the answer to the decision is "YES," this indicates that the engine is in a purge-state in which purging is conducted, a decision is made at step S54 concerning the achievement of learning conditions. Concerning this achievement of learning condition, the answer of "NO" is provided during an interruption of purging or during the interval of gradually increasing purging. On the other hand, the answer of "YES" is provided for all purge states other than the interval of gradually increasing purging and the interruption of purging. That is, in addition to the interruption of purging where learning of the cold range learned value Cfb3 is performed, the interval of gradually increasing purging is previously established as an interval in which learning is interrupted at the beginning of purging. If the learning conditions have not been achieved, i.e. the answer to the decision made at step S54 is "NO" then control proceeds to step S57 via step S58 where the previous computed hot range learned value Cfb4o(i-1) is retained as a current computed hot range learned value Cfb4o(i). On the other hand, if the conditions have been achieved, i.e. the answer to the decision is "YES," then, control executes the computation and updating of a hot range learned value Cfb4o at steps S55 and S56.

At step S57, a decision is made as to whether or not the current computed hot range value Cfb4o is smaller than the lower limit guard value (LLGV) of −7%. If it is larger than the lower limit guard value (LLGV), the current computed hot range learned value Cfb4o is memorized as a backup value Cfb4m at step S59. At the same time, the computed hot range learned value Cfb4o is set as a current control value Cfb4 and is sent to the air-fuel ratio control means 37. Conversely, if the current computed hot range learned value Cfb4o is smaller than the lower limit guard value (LLGV), then the cold range learned value Cfb3, found immediately prior to purging, is memorized as a backup value Cfb4m at step S60. Simultaneously, the current computed hot range learned value Cfb4o is substituted for a current control value Cfb4 and is sent to the air-fuel ratio control means 37 at step S60.

After updating of both backup value and control value at step S59 or S60, the control routine is repeated.

The lower limit value (LLV) of, for instance −15%, is established as the control value Cfb4 based on elements of the entire system that cause fluctuations in the same manner as in the previous embodiment.

With the air-fuel control system, as soon as the opening of the purge valve 29 and the starting of purging of vaporized fuel at the end of warming up of the engine, the cold range learned value Cfb3 is changed to the hot range learned value Cfb4. Since then, the feedback control of air-fuel ratio during purging is performed with this hot range learned value Cfb4 as the control value. In this instance, when purging of vaporized fuel takes place, the gradually increasing purging is performed based on the increasingly varying purging rate Pgrec at the beginning of purging of vaporized fuel and, during the interval of gradually increasing purging, learning by the learning interruption means 40 is interrupted. Thus, it is enabled to prevent a temporary change in the concentration of vaporized fuel from being reflecting on the learned value, even when the highly concentrated vaporized fuel in the canister 28 is temporarily purged at the beginning of purging, so that it is enabled to prevent the generation of deviations in air-fuel ratio caused due to the reflection of the temporary large change in the concentration of vaporized fuel on the learned value.

The present invention is not limited to the first and second embodiments described above, but also encompasses various other embodiments and variants, which fall within the scope and spirit of the invention. For example, in the first embodiment, although the learning interruption means 40 is accompanied by the learning means 38 and the learned value setting means 39, it would also be appropriate to omit the learning interruption means 40. Even in this case, because the established learned value is given by multiplying a computed learned value with a increasingly varying purge rate, and essentially corresponds to the purged amount of vaporized fuel resulting from the gradual increase of purge, it is enabled to prevent deviations in air-fuel ratio caused by using the learned value in the previous full purging since the beginning of the interval of gradually increasing purging.

In the second embodiment, although the interval of gradually increasing purging has been established as the interval for the interruption of learning, nevertheless it would also be appropriate to substitute the interval in which the highly concentrated vaporized fuel is purged at the start of the vaporized fuel purge for this learning interruption interval. Furthermore, although the learning interruption means is used as the means for execution of the control of gradually increasing purging of vaporized fuel at the initiation of purging, nevertheless it may be used as the means for execution of the initiation control of purging of vaporized fuel other than the control of gradually increasing purging of vaporized fuel.

In any of the embodiments described above, although the learned value takes two different types, namely a cold range learned value Cfb3 and a hot range learned value Cfb4, and the backup value is updated by the cold range learned value Cfb3 when the hot range learned value Cfb4 becomes smaller than the lower limit guard value (LLGV), nevertheless, if performing the learning control using as the learned value a single value, it may also be appropriate, for instance, to set the backup value to zero (0) when this learned value becomes smaller than the lower limit guard value (LLGV) due to purging. In other words, it would be appropriate to set the value memorized as the backup value Cfb4m in step S21 of FIG. 6 or in step S60 in FIG. 8 to zero (0) rather than a cold range learned value Cfb3.

As has been described above, with the air-fuel ratio control system of the present invention, upon the resumption of supplying of vaporized fuel after a temporarily interruption of it, a value is established by the learned value setting means as a learned value for the interval of gradually increasing fuel supply for the initiation of supplying of vaporized fuel, which value changes gradually over the purge gradual increase interval from 0 to the learned value obtained during the previous full purge state, in correspondence to the amount of gradual increase in the vaporized fuel supply, feedback control of the air-fuel ratio being performed by the learned value. Therefore, it is possible to achieve a good correlation between the amount of gradual increase in the vaporized fuel purge upon the restarting of the vaporized fuel purging and the learned value set by the learned value setting means. As a result, in comparison to use of the learned value from the previous full purge state, even during the interval of gradual increase, in purging during the restarting of the purging, it is possible to prevent the generation of aberrations in the air-fuel ratio caused by using the learned value at the time in which the desired quantity is completely supplied, even if the quantity of vaporized fuel supplied has not reached the desired amount, thereby realizing more exact air-fuel ratio control.

In addition, learning by the learning means is suppressed by the leaning interruption means during the gradual increase in the supply of vaporized fuel. Therefore, the correspondence between the quantity of vaporized fuel gradually supplied and the learned value set by the learned value setting means increases, making prevention of the generation of aberrations in the air-fuel ratio more exact.

Furthermore, learning by the learning means is suppressed by the learning interruption means during a specific set time at the start of the supply of vaporized fuel from the vaporized fuel supply means. Because of this, it is possible to prevent temporary fluctuations in the vaporized fuel concentration from being reflected in the learned value, even when highly concentrated vaporized fuel is temporarily supplied at the start of purging, thereby making it possible to prevent the generation of aberrations in the air-fuel ratio that are caused by the temporary rapid fluctuation in vaporized fuel concentration at the start of vaporized fuel purging.

It is to be understood that although the present invention has been described in detail with respect to preferred embodiments, various other embodiments and variants may occur to those skilled in the art, which fall within the scope and spirit of the invention. Such other embodiments and variants are intended to be covered by the following claims.

What is claimed is:

1. An air-fuel ratio control system comprising:

an internal combustion engine;

a sensor for detecting a parameter from an exhaust gas discharged from the engine;

a fuel injector for injecting fuel from a fuel tank into the engine;

vaporized fuel supplying means for supplying vaporized fuel from the fuel tank to the engine; and control means for (1) feedback controlling an air-fuel ratio of a mixture to be supplied into the engine, based on the parameter detected from the exhaust gas discharged from the engine, so as to set said air-fuel ratio to a target air-fuel ratio, (2) gradually increasing an amount of vaporized fuel supplied to a necessary level during an initial interval of supplying said vaporized fuel, (3) learning and updating a control value used in feedback controlling said air-fuel ratio of the mixture based on a deviation of said air-fuel ratio from said target air-fuel ratio while supplying said vaporized fuel, (4) gradually changing said control value, upon a resumption of supplying said vaporized fuel, from zero (0) to a learned control value obtained during a preceding period of supplying vaporized fuel according to a gradually increasing amount of vaporized fuel supplied over an interval in which an amount of vaporized fuel supplied is gradually increased, and (5) operating said fuel injector to supply a specific amount of injected fuel from the fuel tank to the engine based on said control value.

2. An air-fuel ratio control system as defined in claim 1, wherein said control means interrupts learning while said amount of vaporized fuel supplied is gradually increased.

3. An air-fuel ratio control system comprising:

an internal combustion engine;

a sensor for detecting a parameter from an exhaust gas discharged from the engine;

a fuel injector for injecting fuel from a fuel tank into the engine;

vaporized fuel supplying means for supplying vaporized fuel from the fuel tank to the engine; and control means for (1) feedback controlling an air-fuel ratio of a mixture to be supplied into the engine, based on the parameter detected from the exhaust gas discharged from the engine, so as to set said air-fuel ratio to a target air-fuel ratio, (2) learning and updating a control value used in feedback controlling said air-fuel ratio of the mixture based on a deviation of said air-fuel ratio from said target air-fuel ratio while supplying said vaporized fuel, (3) interrupting learning during a predetermined interval from initiation of supplying said vaporized fuel, and (4) operating said fuel injector to supply a specific amount of injected fuel from the fuel tank to the engine based on said control value.

4. An air-fuel ratio control system as defined in claim 1, and further comprising a sensor for detecting a temperature of said engine, wherein said control means alters said control value according to the temperature of said engine.

5. An air-fuel ratio control system as defined in claim 1, and further comprising a sensor for detecting loads on said engine, wherein said control means alters said control value according to the loads on said engine.

6. An air-fuel ratio control system as defined in claim 5, and further comprising a sensor for detecting a temperature of said engine, wherein said control means further alters said control value according to the temperature of said engine.

7. An air-fuel ratio control system as defined in claim 1, and further comprising means for detecting operating conditions of said engine, wherein said control means further alters said control value according to the operating conditions of said engine.

8. An air-fuel ratio control system as defined in claim 2, and further comprising a sensor for detecting a temperature of said engine, wherein said control means alters said control value according to the temperature of said engine.

9. An air-fuel ratio control system as defined in claim 2, and further comprising a sensor for detecting loads on said engine, wherein said control means alters said control value according to the loads of said engine.

10. An air-fuel ratio control system as defined in claim 9, and further comprising a sensor for detecting a temperature of said engine, wherein said control means further alters said control value according to the temperature of said engine.

11. An air-fuel ratio control system as defined in claim 2, and further comprising means for detecting operating conditions of said engine, wherein said control means further alters said control value according to operating conditions of said engine.

12. An air-fuel ratio control system as defined in claim 3, and further comprising a sensor for detecting a temperature of said engine, wherein said control means alters said control value according to the temperature of said engine.

13. An air-fuel ratio control system as defined in claim 3, and further comprising a sensor for detecting loads on said engine, wherein said control means alters said control value according to the loads on said engine.

14. An air-fuel ratio control system as defined in claim 13, and further comprising a sensor for detecting a temperature of said engine, wherein said control means further alters said control value according to the temperature of said engine.

15. An air-fuel ratio control system as defined in claim 3, and further comprising means for detecting operating conditions of said engine, wherein said control means further alters said control value according to operating conditions of said engine.

* * * * *